US012203686B2

(12) United States Patent
Jansen

(10) Patent No.: US 12,203,686 B2
(45) **Date of Patent: *Jan. 21, 2025**

(54) METHOD AND APPARATUS FOR ISOTHERMAL COOLING

(71) Applicant: Rolls-Royce North American Technologies Inc., Indianapolis, IN (US)

(72) Inventor: Eugene Charles Jansen, Stafford, VA (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/543,612

(22) Filed: Dec. 18, 2023

(65) Prior Publication Data

US 2024/0118006 A1 Apr. 11, 2024

Related U.S. Application Data

(63) Continuation of application No. 17/541,198, filed on Dec. 2, 2021, now Pat. No. 11,892,208, which is a continuation of application No. 16/605,041, filed as application No. PCT/US2018/029782 on Apr. 27, 2018, now Pat. No. 11,215,383.

(60) Provisional application No. 62/492,986, filed on May 2, 2017.

(51) Int. Cl.

| | |
|---|---|
| ***F25B 40/00*** | (2006.01) |
| ***F25B 6/00*** | (2006.01) |
| ***F25B 40/02*** | (2006.01) |
| ***F25B 41/20*** | (2021.01) |

(52) U.S. Cl.

CPC ..... *F25B 40/00* (2013.01); *F25B 6/00* (2013.01); *F25B 40/02* (2013.01); *F25B 41/20* (2021.01); *F25B 2400/13* (2013.01)

(58) Field of Classification Search

CPC ..... F25B 40/00; F25B 40/02; F25B 41/20; F25B 6/00; F25B 2400/13

See application file for complete search history.

(56) References Cited

U.S. PATENT DOCUMENTS

| | | | |
|---|---|---|---|
| 4,136,528 | A | 1/1979 | Vogel et al. |
| 4,259,848 | A | 4/1981 | Voigt |
| 4,694,662 | A | 9/1987 | Adams |
| 5,070,707 | A | 12/1991 | Ni |
| 5,174,123 | A | 12/1992 | Erickson |
| 5,186,013 | A | 2/1993 | Durso |

(Continued)

FOREIGN PATENT DOCUMENTS

| | | | |
|---|---|---|---|
| EP | 624763 | A1 | 11/1994 |
| WO | 2018204184 | A1 | 11/2018 |

*Primary Examiner* — Miguel A Diaz

(74) *Attorney, Agent, or Firm* — Barnes & Thornburg LLP

(57) ABSTRACT

A cooling apparatus includes a first fluid flowpath and a second fluid flowpath. The first fluid flowpath includes a subcooler having a first side in fluid communication with the first fluid flowpath; a flow control valve; a primary evaporator assembly including at least one evaporator configured to be disposed in thermal communication with a heat load; and a pressure regulator operable to control a saturation pressure within the at least one evaporator. The second fluid flowpath is in fluid communication with a second side of the subcooler.

20 Claims, 4 Drawing Sheets

(56) References Cited

U.S. PATENT DOCUMENTS

| | | | |
|---|---|---|---|
| 5,211,025 | A | 5/1993 | Ni et al. |
| 6,820,434 | B1 | 11/2004 | Gutheim et al. |
| 8,069,684 | B2 | 12/2011 | Heinbokel et al. |
| 8,297,065 | B2 | 10/2012 | Vaisman et al. |
| 9,217,590 | B2 | 12/2015 | Cogswell et al. |
| 9,353,980 | B2 | 5/2016 | Ignatiev |
| 10,088,202 | B2 | 10/2018 | Huff et al. |
| 2002/0139128 | A1 | 10/2002 | Suzuki et al. |
| 2009/0293515 | A1 | 12/2009 | Lifson et al. |
| 2010/0037650 | A1 | 2/2010 | Lee et al. |
| 2011/0023514 | A1 | 2/2011 | Mitra et al. |
| 2011/0203309 | A1 | 8/2011 | Okazaki |
| 2012/0023975 | A1 | 2/2012 | Yoon et al. |
| 2012/0117988 | A1 | 5/2012 | Mitra et al. |
| 2012/0167601 | A1 | 7/2012 | Cogswell et al. |
| 2012/0192579 | A1 | 8/2012 | Huff et al. |
| 2012/0227426 | A1 | 9/2012 | Deaconu |
| 2013/0091868 | A1 | 4/2013 | Campbell et al. |
| 2013/0091874 | A1 | 4/2013 | Sillato et al. |
| 2013/0298593 | A1 | 11/2013 | Christensen |
| 2014/0326002 | A1 | 11/2014 | Sunderland et al. |
| 2014/0326018 | A1 | 11/2014 | Ignatiev |
| 2015/0253040 | A1 | 9/2015 | Aschan et al. |
| 2016/0138847 | A1 | 5/2016 | Zimmermann |
| 2017/0159977 | A1 | 6/2017 | Hellmann |
| 2019/0086130 | A1 | 3/2019 | Hellmann |
| 2019/0170025 | A1 | 6/2019 | Phelps, Sr. |
| 2019/0360730 | A1* | 11/2019 | Hagh ..... F25B 49/02 |
| 2019/0368786 | A1 | 12/2019 | Newel et al. |
| 2021/0180851 | A1 | 6/2021 | Zha |

* cited by examiner

METHOD AND APPARATUS FOR ISOTHERMAL COOLING

CROSS REFERENCE TO RELATED APPLICATIONS

This application is a continuation of and claims priority to and the benefit of U.S. patent application Ser. No. 17/541,198, filed 2 Dec. 2021, which is a continuation of and claims priority to and the benefit of U.S. patent application Ser. No. 16/605,041, filed 14 Oct. 2019, which is a National Stage Entry of and claims priority to and the benefit of International Patent Application Serial Number PCT/US18/29782, filed 27 Apr. 2018, which claims priority to and the benefit of U.S. Provisional Patent Application Number 62,492,986, filed 2 May 2017, the disclosures of which are now expressly incorporated herein by reference.

FIELD OF THE DISCLOSURE

The present disclosure relates generally to cooling and refrigeration, and more particularly relates to isothermal cooling apparatus and processes.

BACKGROUND

Equipment, buildings, and vehicles may be cooled traditionally with two-phase cooling or refrigeration apparatus. In some applications, it is desirable to reject heat at a specified temperature (i.e., isothermal heat rejection).

Isothermal heat rejection at a specified temperature with multiple evaporator channels and evaporators may be difficult to achieve. Most industry standard methods distribute liquid poorly at inlets to parallel evaporator channels and allow flow to exit beyond stable evaporation vapor quality, which produces poor isothermality and low performance at system evaporators. Other industry standard methods require excessive space and additional rotating equipment to provide ideal conditions at system evaporators.

Direct expansion systems often use two-phase distributors to distribute liquid-vapor mixtures amongst parallel channels. Distribution of liquid flow is generally unsatisfactory and distribution amongst excessive numbers of channels (as in microchannel evaporators) becomes unwieldy. Poor distribution of two-phase distributors results in channels with excess liquid and channels with too little liquid. The channels with less liquid will not cool sufficiently and the channels with more liquid may over-cool. When isothermality or optimal performance of an evaporator is necessary, liquid must be distributed equally. Equal distribution of liquid occurs best when no vapor is present in the fluid.

Flash gas bypass systems have been used and investigated for their ability to distribute nearly pure saturated liquid at the inlets of system evaporators. Flash gas bypass systems are a slight variation of direct-expansion systems where the expanded refrigerant is separated into liquid and vapor after the system expansion device. The vapor is routed from the flash gas tank directly to the compressor inlet, thereby avoiding the pressure drop and mal-distribution at system evaporators. The liquid is routed from the flash gas tank to the evaporator(s) inlet(s). The liquid in the flash gas tank is saturated with minimal to no subcool. Any pressure drop from the flash gas tank liquid outlet to evaporator(s) inlet(s) and then to each channel will cause formation of vapor and thereby increase maldistribution causing sub-optimal evaporator performance and less than ideal isothermality.

Two-phase pumped loops use a pump to circulate liquid to system evaporator(s) and liquid/vapor mix to condenser (s) where the entire system exists at nearly the same saturation pressure. These systems generally require substantial liquid head at the inlet to each pump to avoid cavitation at pump impellers, which can generate vapor and cause premature failure of pumps. Also, it can be difficult to control liquid conditions at the pump inlet of two-phase pumped loops and overly subcooled flow is common with low heat duty conditions. Excessive subcool at evaporator inlets will produce varying temperatures and non-optimal evaporator performance. Two-phase pumped loops also require a separate vapor compression loop to reject heat to higher temperature. The heat exchanger interface between two phase pumped loops and vapor compression systems can be excessively complex to maintain liquid condensate without excessive subcool.

Liquid overfeed systems utilize liquid pumps for distribution of flow to evaporators in conjunction with a vapor compression system in the same loop. Excessive subcool is less likely than in a two-phase pumped loop system, but the same cavitation concerns exist with system pump inlets typically requiring several feet of liquid above pump inlets and generously sized pump inlet pipe/tube.

In view of the above, there remains a need for an apparatus which will provide effective and efficient isothermal cooling.

SUMMARY

The present disclosure may comprise one or more of the following features and combinations thereof.

This need is addressed by a cooling apparatus capable of producing isothermal evaporation conditions for a variety of vapor compression systems including flash gas bypass, direct expansion, absorption and their derivatives. This system controls saturation temperature by way of saturation pressure and provides slightly subcooled flow at the inlet to system evaporators to optimize liquid distribution.

According to one aspect of the technology described herein, a cooling apparatus includes: a first fluid flowpath including the following elements, in downstream flow sequence: a subcooler having a first side in fluid communication with the first fluid flowpath and a second side configured to be disposed in thermal communication with a source of cooling fluid; a flow control valve; a primary evaporator assembly including at least one primary evaporator configured to be disposed in thermal communication with a primary heat load; and a pressure regulator operable to maintain a refrigerant saturation pressure within the primary evaporator at a predetermined set point.

According to another aspect of the technology described herein, a refrigeration apparatus includes: a first fluid flowpath including, in downstream flow sequence: a compressor having an inlet and an outlet; a cooler in fluid communication with the outlet of the compressor; a cooler flow restrictor; a subcooler having a first side connected in fluid communication with the first fluid flowpath and a second side configured to be disposed in thermal communication with a source of cooling fluid; a flow control valve connected in fluid communication with the subcooler; a primary evaporator assembly including at least one primary evaporator configured to be disposed in thermal communication with a primary heat load; and a pressure regulator operable to maintain saturation pressure within the primary evaporator at a predetermined set point, wherein an outlet of the pressure regulator is in fluid communication with the inlet of the compressor.

According to another aspect of the technology described herein, a method of isothermal cooling includes: storing a refrigerant in a separator vessel; discharging the refrigerant as liquid or liquid/vapor mixture from the separator vessel and passing a first stream of the refrigerant through a first side of a subcooler to subcool it to a liquid at a predetermined temperature; passing the first stream of the refrigerant through a flow control valve to expand it to a lower pressure as a liquid; passing the first stream of the refrigerant through a primary evaporator assembly, and absorbing heat from a primary heat load at a predetermined temperature; and using a pressure regulator downstream of the primary evaporator assembly, maintaining a saturation pressure of the first stream of the refrigerant within the primary evaporator assembly at a predetermined value.

These and other features of the present disclosure will become more apparent from the following description of the illustrative embodiments.

BRIEF DESCRIPTION OF THE DRAWINGS

The disclosure may be best understood by reference to the following description taken in conjunction with the accompanying illustrative drawing figures in which.

DETAILED DESCRIPTION

Figure 1:
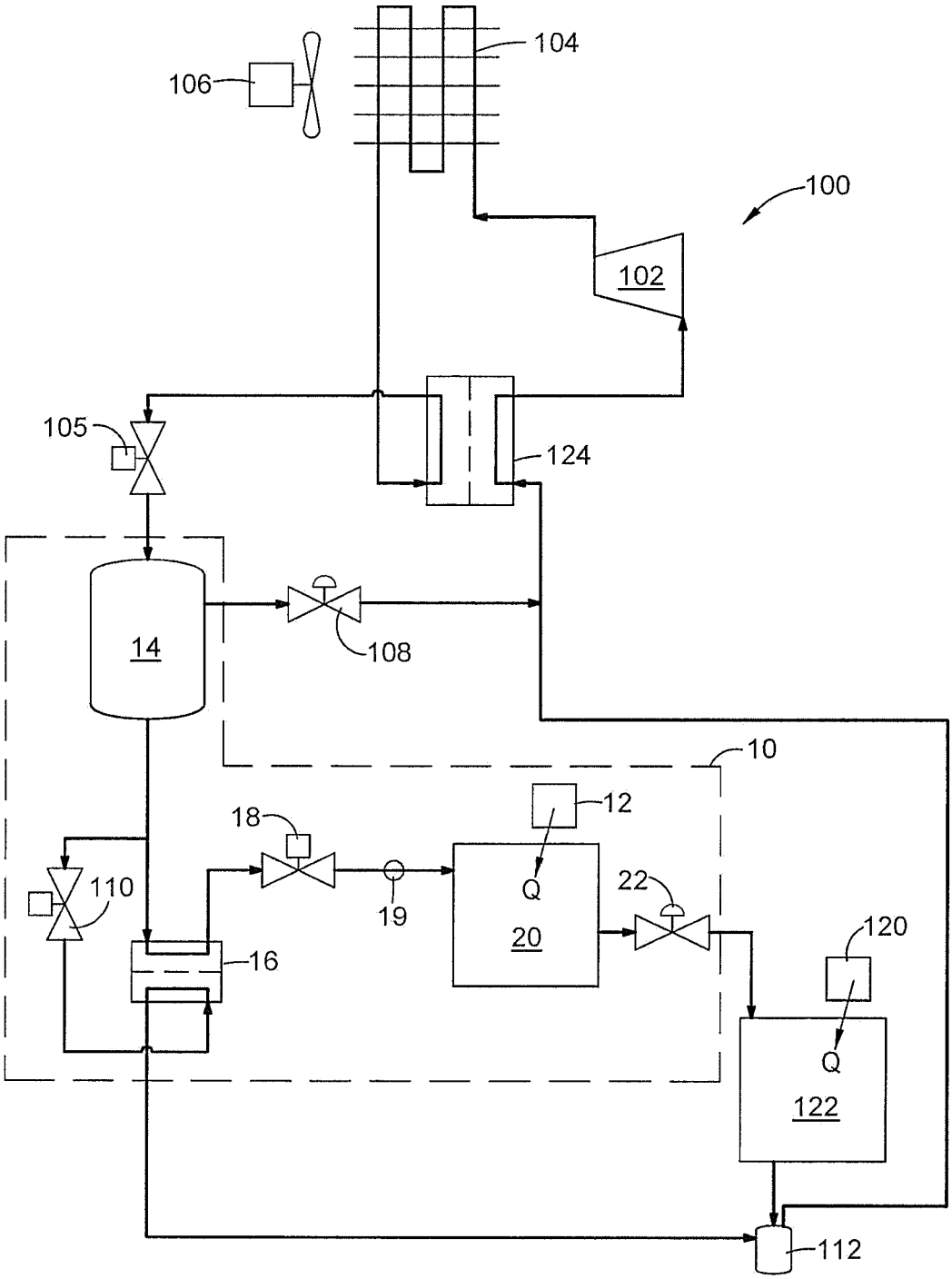
FIG. 1 is a schematic diagram of a refrigeration apparatus incorporating a cooling apparatus, showing an exemplary subcooling configuration.

For the purposes of promoting an understanding of the principles of the disclosure, reference will now be made to a number of illustrative embodiments illustrated in the drawings and specific language will be used to describe the same.

Referring to the drawings wherein identical reference numerals denote the same elements throughout the various views, FIG. 1 depicts an exemplary cooling apparatus 10 (bounded by a dashed line). The cooling apparatus 10 is operable to remove heat from at least one heat load. As used herein the term "heat load" refers to any device, system, or item of equipment which generates heat that needs to be removed. In particular, the heat load may be an isothermal heat load, meaning that heat must be removed at a constant, predetermined temperature for proper functioning of the equipment. In FIG. 1, a primary heat load 12, which is an isothermal heat load, is depicted schematically.

The cooling apparatus 10 fundamentally operates by providing a low-temperature liquid refrigerant to an evaporator which is thermally coupled to the primary heat load 12. Boiling of the refrigerant within the evaporator carries away heat energy. As will be explained in more detail below, the cooling apparatus 10 may operate in an open-loop configuration or in a closed-loop configuration.

As used herein, structures which are "thermally coupled" to each other are configured and/or positioned such that they are capable of transferring heat energy between each other. The mode of heat transfer may be conduction, convection, radiation, or any combination thereof. For example, two mechanical elements in physical contact may be capable of heat transfer by direct conduction and thus would be considered "thermally coupled". As another example, two mechanical elements mutually exposed to fluid flow within a duct may be capable of heat transfer by convection, and thus would be considered "thermally coupled".

As used herein, the term "refrigerant" refers to any fluid capable of being effectively manipulated in the cooling apparatus 10 (e.g., stored, transported, compressed, valved, pumped, etc.) and of undergoing phase transitions from a liquid to a gas and back again One of ordinary skill in the art may select a desired refrigerant to suit a particular application based on its physical properties. Nonlimiting examples of commercially available substances used as refrigerants include fluorocarbons, especially chlorofluorocarbons and hydrofluorocarbons, hydrocarbons (e.g., propane), ammonia, and inert gases (e.g. nitrogen).

It will be understood that the components of the cooling apparatus 10 are interconnected by appropriate conduits, pipes, valves, etc as required to control the flow of refrigerant through the cooling apparatus 10. These connections may be shown schematically in the various figures, where conduits and/or pipes are represented by single lines. It will be understood that the term "in fluid communication" describes a connection between two or more components which permits a fluid (e.g. refrigerant) to flow there between.

The cooling apparatus 10 includes a separator vessel 14 which stores liquid refrigerant. In the illustrated example, the separator vessel 14 is a flash gas bypass storage tank.

A subcooler 16 is located downstream of the separator vessel 14. The subcooler 16 is a heat exchanger having a first fluid flowpath or interface communicating with the refrigerant (referred to as a "first side") and a second fluid flowpath or interface communicating with a cold sink (referred to as a "second side"). As used herein the term "cold sink" refers to any source of low fluid to which heat can be rejected. Several examples of potential cold sinks are described below. As will be explained in more detail below, the purpose of the subcooler 16 is to subcool the liquid refrigerant. As used herein, the term "subcooled" refers to a refrigerant in its liquid phase, at a temperature less than its normal boiling point.

A flow control valve (also referred to as an expansion valve or metering valve) 18 is located downstream of the subcooler 16. The flow control valve 18 functions to meter the flow of liquid refrigerant. The flow control valve 18 may be mechanical, thermomechanical, or electromechanical in operation, and its control may be manual, automatic, or computer-controlled. The primary purpose and function of the flow control valve 18 is to modulate the cooling capacity of the cooling apparatus 10. The flow control valve 18 is an example of one type of flow restrictor. As used herein, the term "flow restrictor" refers to any device which throttles a fluid flow, producing a pressure drop. Synonyms for "flow restrictor" include "throttle", "thermal expansion device", or "expansion valve". Known types of flow restrictors include, for example, porous plugs, capillary tubes, calibrated orifices, and valves. In general, the term "flow restrictor" may include devices which have a fixed flow restriction or pressure drop, as well as devices which have a variable flow restriction or pressure drop.

A primary evaporator assembly 20 is located downstream of the flow control valve 18. The primary evaporator assembly 20 is thermally connected to the primary heat load 12. The primary evaporator assembly 20 includes one or more evaporators. A typical evaporator is a type of heat exchanger which includes a flowpath for receiving the refrigerant, and a heat transfer interface for receiving heat loads. While any type of evaporator may be used, the cooling apparatus 10 is especially suitable for use with microchannel evaporators and/or multiple evaporators in parallel, as the cooling apparatus 10 provides reliable distribution of liquid refrigerant.

A pressure regulator 22 is located downstream of the primary evaporator assembly 20 and configured so as to control the saturation pressure of the refrigerant within the primary evaporator assembly 20. The pressure regulator 22 may be mechanical, thermomechanical, or electromechanical in operation, and its control may be manual, automatic, or computer-controlled.

Basic open-loop operation of the cooling apparatus 10 is as follows. The separator vessel 14 is charged with liquid refrigerant. Typically, the liquid refrigerant would not be subcooled to any substantial degree and is thus subject to unintended vaporization (i.e. generation of "flash gas") downstream of the separator vessel 14, from numerous causes such as heat absorption through pipe walls and/or pressure losses in pipes and valves.

Accordingly, the refrigerant is subcooled by passing it through the subcooler 16 downstream of the separator vessel 14. In one example, subcool of evaporator inlet flow is managed so that near-zero subcool is present at evaporator channel inlets for optimal distribution and optimal boiling. Saturation pressure is measured upstream of the primary evaporator assembly 20 and used to determine saturation temperature. A minimal amount of subcool is predetermined and an evaporator inlet temperature is calculated as: desired evaporator inlet temperature=evaporator inlet saturation temperature-desired subcool. The degree or magnitude of subcooling may be controlled using a closed-loop process. For example, a temperature transducer 19 may be provided at the outlet of the flow control valve 18 and used as a reference (e.g. feedback, feedforward) for subcooler control. For purposes of explanation, subcooler 16 may be described as "configured for closed-loop control", with the understanding that the heat transfer rate or temperature drop in the subcooler 16 may be controlled by the operation of other devices within the cooling apparatus 10, e.g., the operation of the cold sink described above.

Subcooling in the subcooler 16 may be accomplished by various means, each of which involves rejection of heat from the refrigerant to a cold sink within the subcooler 16. Several examples of specific subcooling apparatus and methods are described in more detail below.

The subcooled liquid is provided to the flow control valve 18. The flow control valve 18 meters the flow of liquid refrigerant, reducing its pressure and temperature. The flow control valve 18 may be mechanical, thermomechanical, or electromechanical in operation, and its control may be manual, automatic, or computer-controlled.

The liquid refrigerant then passes to the primary evaporator assembly 20, where it absorbs heat from the primary heat load 12 and partially vaporizes.

The pressure regulator 22 downstream of the primary evaporator assembly 20 operates to control the saturation pressure of the mixture of liquid/vapor phase refrigerant within the primary evaporator assembly 20 and thus maintain the saturation temperature of the refrigerant at a predetermined value. It is noted that the set point may vary depending on system conditions or operational needs. As noted above, the pressure regulator 22 may be mechanical, thermomechanical, or electromechanical in operation, and its control may be manual, automatic, or computer-controlled.

Collectively, the fluid flow from the separator vessel 14, through subcooler 16, flow control valve 18, primary evaporator assembly 20, and pressure regulator 22 may be referred to as a "first stream" of fluid. Collectively, the hardware elements which enclose and conduct the flow of the first stream of fluid may be referred to as a "first fluid flowpath", or alternatively "a first fluid circuit".

When the cooling apparatus 10 is operated to maintain isothermal cooling as described above, it is anticipated that the refrigerant flow out of the primary evaporator assembly 20 will generally be a saturated mixture of liquid and gas and will have a vapor quality (i.e. mass fraction of vapor) in a range of approximately 65% to 85%.

In a pure open-loop embodiment, the spent refrigerant could simply be discharged to the external environment or collected for disposal.

The cooling apparatus 10 described above provides a benefit for isothermal cooling even when operating in an open-loop configuration. However, it may be integrated into a conventional refrigeration apparatus or system to operate in closed-loop configuration.

As further shown in FIG. 1, the cooling apparatus 10 may be incorporated into a closed loop refrigeration apparatus 100. In the illustrated example, the refrigeration apparatus 100 includes, in fluid flow sequence, a compressor 102, a cooler 104, an optional internal heat exchanger 124, a flow restrictor 105, and the cooling apparatus 10. An outlet of the flow restrictor 105 is in flow communication with an inlet of the separator vessel 14, and an inlet of the compressor 102 is in flow communication with the exit of the cooling apparatus 10. As noted above, fluid communication connections between the various components may be shown schematically in the various figures.

The compressor 102 comprises one or more devices operable to receive low-pressure refrigerant in the gas phase and compress it to a higher pressure. Nonlimiting examples of suitable compressors include scroll compressors, reciprocating piston compressors, and centrifugal compressors. The compressor may be driven by a prime mover such as an electric motor (not shown).

The cooler 104 comprises one or more devices operable to receive high-pressure refrigerant from the compressor 102 and remove heat from the refrigerant. In a two-phase system, operation of the cooler 104 causes the refrigerant to condense to a liquid; in such systems the cooler 104 may also be referred to as a "condenser" Where other refrigerants are used, such as gases or trans-critical fluids, cooling may occur without a phase change. One nonlimiting example of a suitable device for the cooler 104 is a refrigerant to air heat exchanger, using one or more fans 106 to move air across the air side of the heat exchanger.

The flow restrictor 105 is connected to an outlet of the cooler 104. The purpose and function of the flow restrictor 105 is to create a pressure differential such that the refrigerant pressure (and therefore temperature) in cooler 104 will be sufficiently high to permit heat to be rejected to the ambient environment.

The outlet of the flow restrictor 105 is connected to an inlet of the separator vessel 14. In the illustrated example, the separator vessel 14 is a flash gas bypass storage tank which is configured to store liquid refrigerant in one portion thereof. Any vapor which may be received into the separator vessel 14 (or generated within the separator vessel 14) is removed through a bypass valve 108 (which may be a pressure regulating valve) and routed back to the inlet of the compressor 102.

The refrigeration apparatus 100 may incorporate a cold sink for the subcooler 16 of the cooling apparatus.

In the example shown in FIG. 1, subcooling is accomplished by diverting a portion of the flow (i.e., two-phase liquid-vapor mix or pure liquid) from the separator vessel 14, expanding it through a flow restrictor 110 to a lower saturation pressure/temperature than the primary evaporator assembly 20, and passing it through the second side of the subcooler 16, where it absorbs heat from evaporator inlet flow to slightly subcool liquid on the way to the primary evaporator assembly 20. This diverted flow may be referred to as a "second stream" of fluid. It is an example of a "cold sink" for purposes of the present disclosure. Once used for subcooling, the diverted refrigerant flow (i.e., the second stream) may be rejoined with the system flow at any desired point downstream of the pressure regulator 22. In the illustrated example, it is rejoined to the system flow at an optional suction accumulator 112 which is positioned downstream of the pressure regulator 22 and upstream of the compressor inlet. Collectively, the hardware elements which enclose and conduct the flow of the second stream of fluid may be referred to as a "second fluid flowpath" or alternatively a "second fluid circuit". The terminal points of the second fluid circuit where it joins the first fluid circuit may be referred to as first and second ends thereof.

Figure 2:
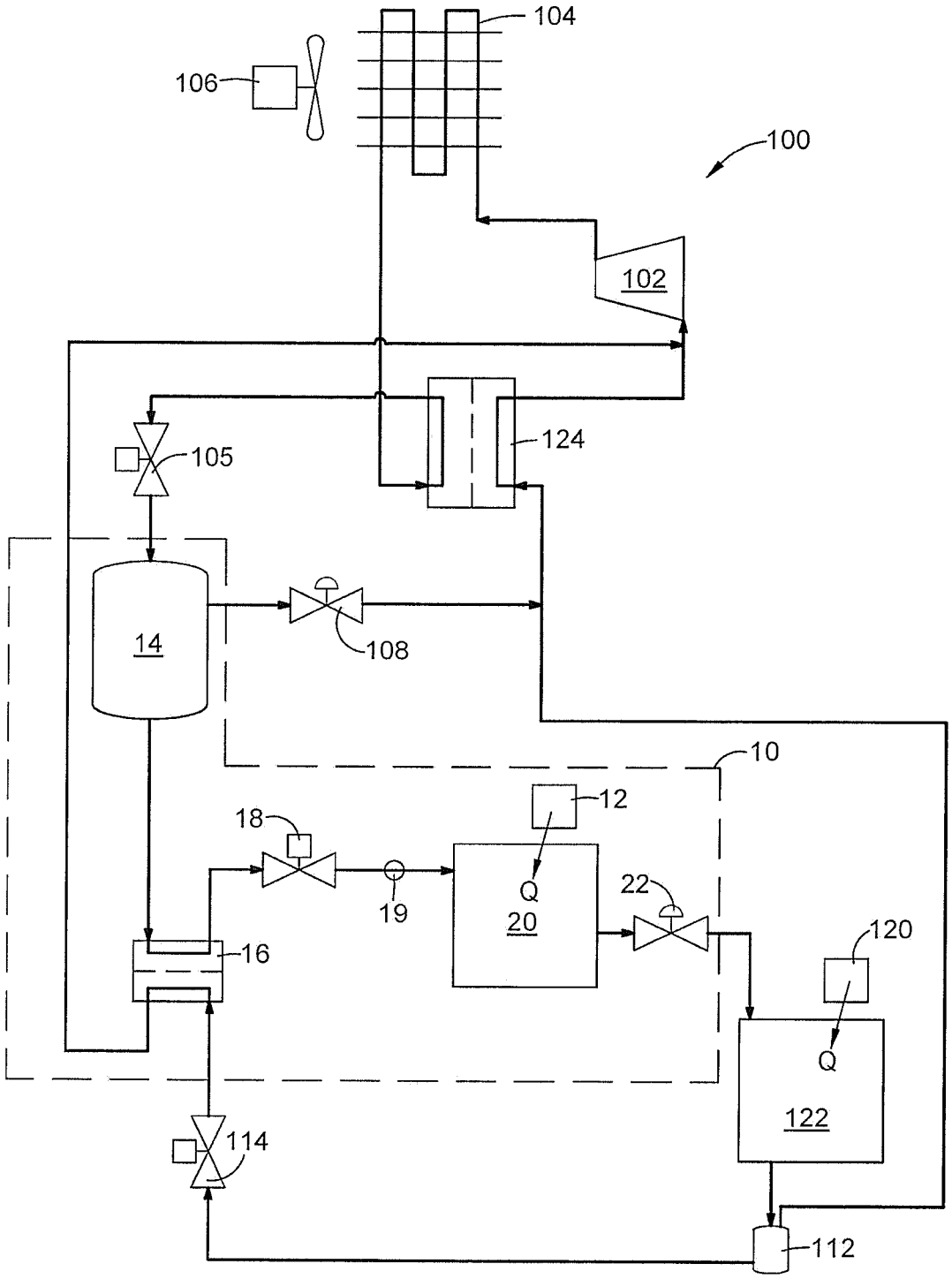
FIG. 2 is a schematic diagram of a refrigeration apparatus incorporating a cooling apparatus, showing an alternative subcooling configuration.

FIG. 2 illustrates a variation of the refrigeration apparatus 100, showing another exemplary subcooling configuration. In this example, liquid refrigerant remaining downstream of the primary evaporator assembly 20 is collected in an optional suction accumulator 112 which is positioned downstream of the pressure regulator 22. Liquid refrigerant is then taken from the suction accumulator 112 and expanded through a flow restrictor 114 to a lower saturation pressure/temperature than the primary evaporator assembly 20 and is passed through the second side of the subcooler 16, where it absorbs heat from evaporator inlet flow to slightly subschool liquid on the way to the primary evaporator assembly 20. This liquid flow from suction accumulator 112 may be referred to as a "second stream" of fluid. It is another example of a "cold sink" for purposes of the present disclosure. Collectively, the hardware elements which enclose and conduct the flow of the second stream of fluid may be referred to as a "second fluid flowpath" or alternatively a "second fluid circuit". The terminal points of the second fluid circuit where it joins the first fluid circuit may be referred to as first and second ends thereof.

Figure 3:
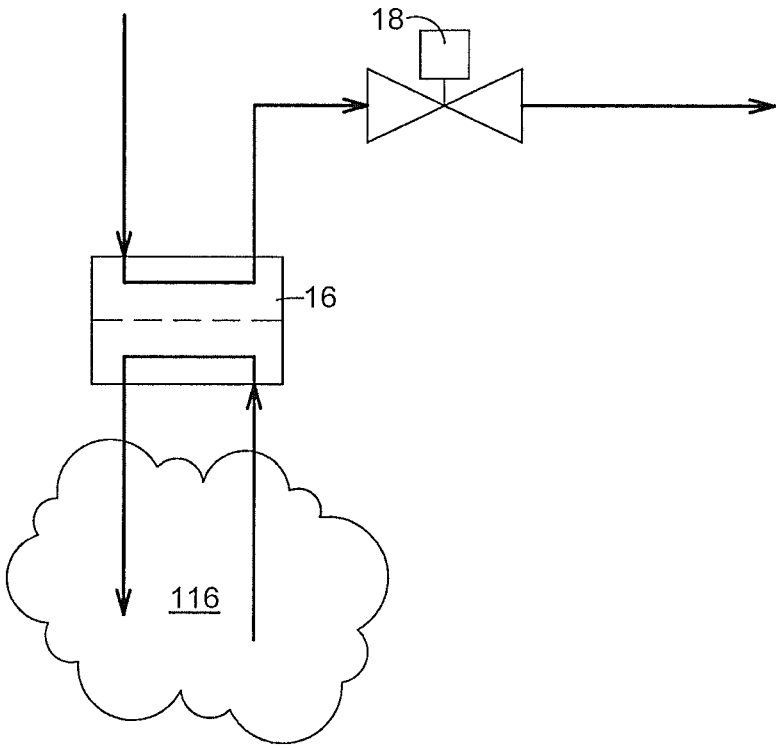
FIG. 3 is a schematic diagram of a portion of a refrigeration apparatus incorporating a cooling apparatus, showing another alternative subcooling configuration.

FIG. 3 illustrates another exemplary subcooling configuration. In this example, an arbitrary cold fluid (shown generically at 116) is supplied to the subcooler 16. Any cold fluid existing at a temperature below that of the refrigerant may be used. For example, an environmental source such as an open body of water may be used, or chilled refrigerant from a separate conventional refrigeration apparatus (not shown) may be used. This cold fluid is yet another example of a "cold sink" for purposes of the present disclosure.

When the cooling apparatus 10 is operated to maintain isothermal cooling as described above, it is anticipated that the refrigerant flow out of the primary evaporator assembly 20 will generally be a saturated mixture of liquid and gas and will have a vapor quality in a range of approximately 65% to 85%. Generally, the compressor 102 will be intolerant of ingesting liquid. The presence of a significant amount of liquid may lead to inefficiency, shortened life, and/or damage to the compressor 102. Accordingly, in most embodiments, it will be necessary or desirable to evaporate the liquid refrigerant remaining downstream of the primary evaporator assembly 20.

As one example, evaporation of the remaining liquid can be accomplished by using the refrigerant to absorb heat from secondary heat loads 120 (also referred to as "non-isothermal loads") that do not require the isothermality of the primary heat loads 12. This additional heat can be added in the primary evaporator assembly 20, or one or more secondary evaporators, which may be located upstream or downstream of the pressure regulator 22. In the example shown in FIG. 1, a secondary evaporator 122 is shown located downstream of the pressure regulator 22.

As another example, evaporation of remaining liquid can be accomplished by using the refrigerant to absorb heat from the high-pressure side of the system post-condenser by way of an internal heat exchanger. In the example shown in FIG. 1, an internal heat exchanger 124 has a first side in thermal communication with the fluid entering the compressor 102, and a second side in thermal communication with the flow exiting the cooler 104. The internal heat exchanger 124 would also serve to produce lower vapor quality at the outlet of the system expansion device thereby simplifying the process of separation of liquid and vapor in a flash tank. It is noted that the internal heat exchanger 124, as well as any of the other heat exchangers described herein, may incorporate any type of internal structure which is effective to permit heat transfers. Nonlimiting examples of known flow configurations include parallel flow and cross flow.

Figure 4:
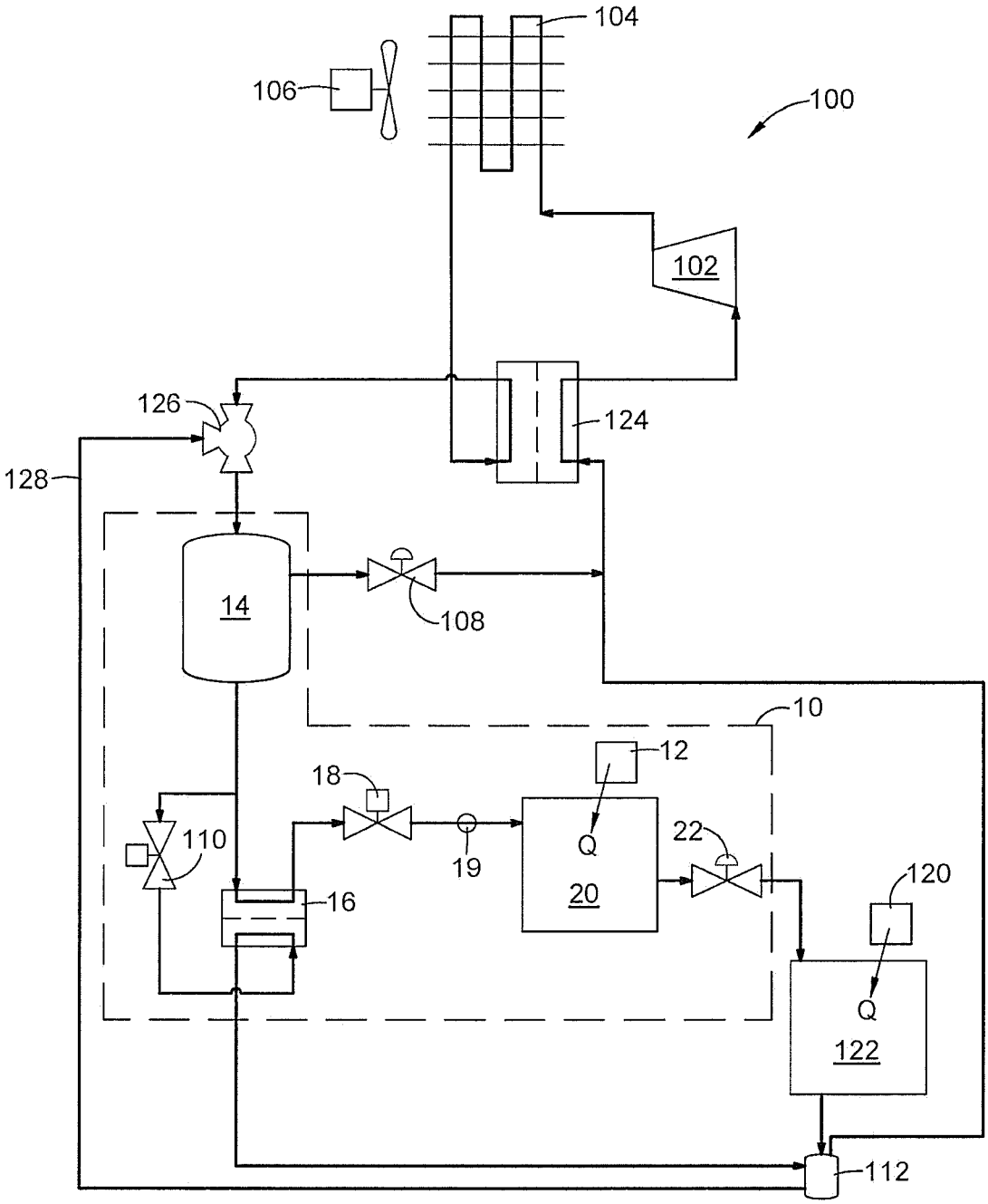
FIG. 4 is a schematic diagram of a refrigeration apparatus incorporating a cooling apparatus, and further incorporating an eductor for returning refrigerant to a separator vessel.

Optionally, means may be provided for returning liquid refrigerant to the separator vessel 14 from a point downstream of the primary evaporator assembly 20. For example, FIG. 4 shows a variation of the refrigeration apparatus 100 in which an optional suction accumulator 112 is positioned downstream of the pressure regulator 22 and upstream of the compressor inlet. An eductor 126 is connected between the cooler 104 and the separator vessel 14. An eductor, also known as a jet pump, includes a motive fluid inlet, a suction inlet, and an outlet. Internally, the eductor 126 includes a motive fluid nozzle upstream of a converging-diverging nozzle. In operation, fluid discharged from the motive fluid nozzle creates a Venturi effect to entrain another fluid. Such devices are commercially available. In the illustrated example, the eductor 126 is connected such that flow from the cooler 104 to the separator vessel 14 provides the motive force. A suction line 128 connects the suction accumulator 112 (or alternatively, some other point downstream of the primary evaporator assembly 20) and the suction inlet of the eductor 126. In operation, the eductor 126 will draw liquid refrigerant from the suction accumulator 112 and introduce it into the separator vessel 14.

The cooling apparatus and method described above is capable of producing isothermal evaporation conditions for a variety of vapor compression systems including flash gas bypass, direct expansion, or absorption, and their derivatives. This system controls saturation temperature by way of saturation pressure and provides slightly subcooled flow at the inlet to system evaporators to optimize liquid distribution. Isothermal evaporation can be maintained at a specified temperature. As such, the merits of the cooling apparatus stand apart from the mechanism employed for heat rejection in the two-phase fluid. However, flash gas bypass systems may be ideal for implementation as the liquid exiting the flash gas tank already exists close to the slightly subcooled state desired at isothermal evaporator inlets.

The foregoing has described a cooling apparatus and method for its operation. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The disclosure is not restricted to the details of the foregoing embodiment(s). The disclosure extends to any novel one, or any novel combination, of the features disclosed in this specification (including any accompanying claims, abstract and drawings), or to any novel one, or any novel combination, of the steps of any method or process so disclosed.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A cooling apparatus comprising:

a source of cooling fluid;

a first fluid flowpath in fluid communication with the source of cooling fluid to receive the cooling fluid from the source of cooling fluid, the first fluid flowpath including:

a subcooler having a first side in fluid communication with the first fluid flowpath; and a flow control valve;

a primary evaporator assembly downstream of the flow control valve, the primary evaporator assembly including at least one primary evaporator configured to be disposed in thermal communication with a primary heat load;

a pressure regulator downstream of the primary evaporator assembly, the pressure regulator operable to maintain a saturation pressure within the primary evaporator at a predetermined set point;

a compressor downstream of the pressure regulator to pressurize the cooling fluid; and a cooler downstream of the compressor for removing heat from the cooling fluid; and a second fluid flowpath in fluid communication with the source of cooling fluid and diverging from the first fluid flowpath downstream of the primary evaporator assembly and configured to pass a portion of the cooling fluid through a second side of the subcooler and return the portion of the cooling fluid to the first fluid flowpath downstream of the primary evaporator assembly and upstream of the compressor such that the portion of the cooling fluid passes through and is pressurized by the compressor before the portion of the cooling fluid is returned to the source of cooling fluid, the second fluid flowpath includes a flow restrictor located upstream of an inlet to the second side of the subcooler and the flow restrictor is configured to expand the portion of the cooling fluid flowing to the second side of the subcooler.

2. The cooling apparatus of claim 1, wherein the source of cooling fluid includes a separator vessel located upstream of an inlet to the first side of the subcooler.

3. The cooling apparatus of claim 2, further comprising a third fluid flowpath fluidly connecting the separator vessel with the first fluid flowpath at a location downstream of the pressure regulator to extract vapor from the separator vessel.

4. The cooling apparatus of claim 3, wherein the first fluid flowpath further includes a suction accumulator located downstream of the pressure regulator and the second fluid flowpath diverges from the first fluid flowpath downstream of the suction accumulator.

5. The cooling apparatus of claim 4, wherein the first fluid flowpath further includes a heat exchanger having a first side located between the primary evaporator and the compressor and a second side located between the cooler and the source of cooling fluid.

6. The cooling apparatus of claim 5, wherein the first fluid flowpath further comprises one or more secondary evaporators downstream of the primary evaporator assembly and the one or more secondary evaporators is configured to be disposed in thermal communication with a secondary heat load.

7. The cooling apparatus of claim 6, wherein the primary evaporator assembly and the one or more secondary evaporators are connected in series.

8. A cooling apparatus comprising:

a source of cooling fluid;

a first fluid flowpath in fluid communication with the source of cooling fluid to receive the cooling fluid from the source of cooling fluid, the first fluid flowpath including:

a subcooler having a first side in fluid communication with the first fluid flowpath; and a primary evaporator assembly located downstream of a flow control valve, the primary evaporator assembly including at least one primary evaporator configured to be disposed in thermal communication with a primary heat load; and a second fluid flowpath in fluid communication with the source of cooling fluid and diverging from the first fluid flowpath downstream of the primary evaporator assembly and configured to pass a portion of the cooling fluid through a second side of the subcooler and return the portion of the cooling fluid to the first fluid flowpath downstream of the primary evaporator assembly and upstream of the compressor such that the portion of the cooling fluid passes through and is pressurized by the compressor before the portion of the cooling fluid is returned to the source of cooling fluid.

9. The cooling apparatus of claim 8, wherein the second fluid flowpath includes a flow restrictor located upstream of an inlet of the second side of the subcooler and the flow restrictor is configured to expand the portion of the cooling fluid flowing to the second side of the subcooler.

10. The cooling apparatus of claim 8, wherein the source of cooling fluid includes a separator vessel located upstream of the subcooler.

11. The cooling apparatus of claim 10, further comprising a third fluid flowpath fluidly connecting the separator vessel with the first fluid flowpath at a location downstream of a pressure regulator to extract vapor from the separator vessel.

12. The cooling apparatus of claim 11, wherein the first fluid flowpath further includes a compressor downstream of the primary evaporator assembly and the third fluid flowpath is fluidly connected with the first fluid flowpath upstream of the compressor.

13. The cooling apparatus of claim 8, wherein the first fluid flowpath further includes the flow control valve located upstream of the primary evaporator assembly to meter a flow of the cooling fluid and a pressure regulator located downstream of the primary evaporator assembly to maintain a saturation pressure within the primary evaporator at a predetermined set point.

14. The cooling apparatus of claim 13, wherein the first fluid flowpath further comprises a compressor downstream of the primary evaporator assembly and a cooler downstream of the compressor.

15. The cooling apparatus of claim 14, wherein the first fluid flowpath further includes a heat exchanger having a first side located between the primary evaporator and the compressor and a second side located between the cooler and the source of cooling fluid.

16. The cooling apparatus of claim 8, wherein the first fluid flowpath further includes a suction accumulator located downstream of a pressure regulator.

17. The cooling apparatus of claim 16, wherein the second fluid flowpath diverges from the first fluid flowpath downstream of the suction accumulator.

18. The cooling apparatus of claim 8, wherein the second fluid flowpath returns the portion of the cooling fluid to the first fluid flowpath upstream of the source of cooling fluid.

19. The cooling apparatus of claim 18, wherein the first fluid flowpath further comprises one or more secondary evaporators downstream of the primary evaporator assembly and the one or more secondary evaporators is configured to be disposed in thermal communication with a secondary heat load.

20. The cooling apparatus of claim 19, wherein the primary evaporator assembly and the one or more secondary evaporators are connected in series.

* * * * *